US006207246B1

(12) United States Patent
Moren et al.

(10) Patent No.: US 6,207,246 B1
(45) Date of Patent: Mar. 27, 2001

(54) NONWOVEN ABRASIVE MATERIAL ROLL

(75) Inventors: Louis S. Moren, Mahtomedi; Douglas S. Spencer, St. Paul; Laurie A. Windisch, Stillwater, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/447,843

(22) Filed: Nov. 23, 1999

Related U.S. Application Data

(63) Continuation-in-part of application No. 09/104,871, filed on Jun. 25, 1998, now abandoned, which is a continuation-in-part of application No. 08/847,551, filed on Apr. 23, 1997, now abandoned, which is a continuation of application No. 08/586,102, filed on Jan. 16, 1996, now abandoned, which is a continuation-in-part of application No. 08/520,954, filed on Aug. 30, 1995, now abandoned.

(51) Int. Cl.[7] ..... B32B 5/02

(52) U.S. Cl. ..... 428/43; 428/143; 428/906; 451/532

(58) Field of Search ..... 428/43, 143, 906; 51/295–298; 451/532

(56) References Cited

U.S. PATENT DOCUMENTS

| | | |
|---|---|---|
| 2,958,593 | 11/1960 | Hoover et al. . |
| 3,688,453 | 9/1972 | Legacy et al. . |
| 4,227,350 | 10/1980 | Fitzer . |
| 4,437,271 | 3/1984 | McAvoy . |
| 5,025,596 | 6/1991 | Heyer et al. . |
| 5,370,338 | 12/1994 | Lewis . |
| 5,712,210 | 1/1998 | Windisch et al. . |

FOREIGN PATENT DOCUMENTS

| | | |
|---|---|---|
| 85 12 084 U | 7/1985 | (DE) . |
| 0 287 286 | 10/1988 | (EP) . |
| 0 480 848 | 4/1992 | (EP) ..... A47K/10/38 |

OTHER PUBLICATIONS 3M brochure entitled *Scotch–Brite™ Surface Conditioning Hand Pads*, 3M Abrasive Systems Division, Saint Paul, MN; document No. 61–5000–9159–2(428)ii (Dec. 1991).

3M brochure entitled *Scotch–Brite™ Cutting and Polishing Rolls*, 3M Abrasive System Division, Saint Paul, MN; document No. 61–5001–0410–6(42.3)R2 (1992).

3M brochure entitled *3M Grindline Express Surface Conditioning Products* 1993, 3M Abrasive System Division, Saint Paul, MN; document No. 60–4400–2475–4 (33.75)VP, Dec. 1993.

3M brochure entitled *3M Grindlines Express Coated Abrasive, Surface Conditioning, and Superabrasive Products* 1996, 3M Abrasive System Division, Saint Paul, MN; document No. 60–4400–0168–7(1613)VP (1996); published as document No. 60–4400–2475–4(33.75)VP in Dec. 1993.

3M brochure entitled *3M™ Stikit™ Gold Abrasive Disc Rolls*, 3M Automotive Trades Division, Saint Paul, MN; document No. 60–4400–4359–8(634)BE (Dec. 1993).

3M brochure entitled *SKIKIT® Gold and STIKIT™ Green Abrasive Disc Rolls*, 3M Automotive Trades Division, Saint Paul, MN; document No. 60–4400–0574–6(120.5)DPI (Dec. 1985).

*Primary Examiner*—Alexander S. Thomas
(74) *Attorney, Agent, or Firm*—James J. Trussell

(57) ABSTRACT

A longitudinally extending web of lofty nonwoven abrasive surface treatment material is provided in a coreless roll form to the end user. Successive wraps of the nonwoven abrasive material have interengaging surfaces sufficient to maintain the material in a spirally wrapped configuration yet being readily separable. A plurality of longitudinally spaced and laterally disposed perforations through the web permit the user to successively separate the web into a plurality of sheets of abrasive surface treatment material. In a preferred embodiment, the roll is encased in a protective shrink wrap sheath, and each sheet is separated from the roll by separating said sheet from an innermost wrap of the roll. In another preferred embodiment, the abrasive surface treatment material includes abrasive particles of 1000 grade or finer.

18 Claims, 4 Drawing Sheets

NONWOVEN ABRASIVE MATERIAL ROLL

CROSS-REFERENCE TO RELATED APPLICATION

This application is a continuation-in-part of U.S. patent application Ser. No. 09/104,871, filed on Jun. 25, 1998, now abandoned, which is a continuation-in-part of U.S. patent application Ser. No. 08/847,551, filed on Apr. 23, 1997, abandoned, which is continuation of U.S. patent application Ser. No. 08/586,102, filed Jan. 16, 1996, abandoned, which is a continuation-in-part of U.S. patent application Ser. No. 08/520,954, filed on Aug. 30, 1995, abandoned.

BACKGROUND OF THE INVENTION

The present invention relates to surface conditioning products, and specifically to surface conditioning sheets comprising a lofty, non-woven abrasive article. The abrasive article can be provided to the user in roll form. The roll material has surfaces which interengage sufficiently to maintain the roll in a spirally wrapped configuration, yet are separable to allow roll unwinding. The roll is perforated to permit sheet separation and removal therefrom.

The low density abrasive products of the type defined in U.S. Pat. No. 2,958,593 and sold under the registered trademark "SCOTCH-BRITE" by Minnesota Mining and Manufacturing Company of St. Paul, Minn., have found significant commercial success as surface treatment products. This type of abrasive product is typically formed of crimped staple fibers which have been formed into a mat and impregnated with resinous binder and abrasive. This material is made available commercially in a wide variety of types to provide many functions. It can be formed as a disc or wheel for mounting on a rotating axis, a belt, a pad for finishing equipment, such as floor treating pads or in sheet form for use as a hand pad. In this latter regard, cut sheets have been provided for use as hand pads in surface finishing applications, such as stripping, scuffing, cleaning or finishing work. Such sheets were provided to users in pre-cut form, sold individually or packaged in stacked form. Such nonwoven abrasive material has also been available in roll form, typically wound on a support core (such as a cardboard core), and then lengths of nonwoven material could be cut to length as desired and removed from the roll.

In use, nonwoven abrasive material hand pads have displaced (in many instances) steel wool pads as the desired surface conditioning product. Steel wool pads shed metallic particles during use, which can lead to numerous problems (e.g., finish imperfections, rust stains, annoying or injurious splinters in a user's fingers, etc.). In addition, steel wool pads tend to snag or tear during use, becoming non-uniform in terms of abrasive qualities and handling characteristics. One advantage that steel wool pads had over the prior art nonwoven abrasive material hand pads, however, was their conformability. The user was able to shape (e.g., fold or configure) a steel wool pad to desired configurations, depending upon the particular application, and the pad would retain that general shape. Prior art nonwoven abrasive material hand pads, while avoiding the problem of shedding particles, have not been suitably conformable for the end user, and could not retain a folded or wadded shape. Even though the faces of the prior art nonwoven abrasive material pads are rough (i.e., abrasive) in nature, they do not engage or adhere on contact with one another. This feature, in combination with the thickness, stiffness and weight of the prior art nonwoven abrasive material prevented such material from maintaining a folded or wadded configuration.

Another advantage that steel wool pads had over the prior nonwoven abrasive material hand pads was the ability to achieve a fine surface finish while providing a desired Bearing Ratio on the abraded surface.

As mentioned above, prior nonwoven abrasive material has been provided to end users only in discrete hand pad or roll form. In the course of manufacturing such nonwoven abrasive materials to form discrete hand pads, it has been known to form a longitudinally extending web of nonwoven abrasive material (such as web 11 in FIG. 1) which is sequentially cut laterally, as at 13, into a plurality of intermediate web sections 15. Each web section 15 is then subjected to a longitudinally-disposed severing, along a plurality of separation lines 17, to form a plurality of pad members 19 therefrom. The severing at each line 17 is not complete (a few strands of the nonwoven material are left uncut between adjacent pad members 19), so the pad members 19 remain connected as a web section 21. Each web section 21 may be further processed for one or more manufacturing steps, including the stacking of several web sections 21, as illustrated at 23. Adjacent stacks 25 of pad members 19 are separated by relative vertical movement (see, e.g., arrows 17 and 29) to break the few strands of nonwoven material that connect adjacent pad members 19 of the same web section 21, into in-process stacks 25. Each separate stack 25 of pad members 19 is then further processed and packaged for distribution to end users, where each pad member 19 thus constitutes a discrete, nonwoven abrasive hand pad.

Mirka, a Finnish company, has sold prior art nonwoven abrasive material in roll form, under the mark "MIRLON", where the roll of material (which is not self-engaging) is encased in a shrink-wrap material as delivered to the end user. The nonwoven abrasive material is removed from this roll by unwinding it off of the innermost wrap of the roll, from adjacent the central axis of the roll, and cutting a piece to whatever length is desired.

SUMMARY OF THE INVENTION

The present invention provides an improved means for packaging, delivering and dispensing lofty nonwoven abrasive surface treatment material. A longitudinally extending web of such material is improved by providing a plurality of longitudinally spaced and laterally disposed weakened areas along the web to permit a user to readily and successively separate the web into a plurality of sheets of abrasive surface treatment material. In a preferred embodiment, each weakened area is defined by perforations formed through the web.

A roll of lofty, nonwoven abrasive surface treatment material is improved by forming a roll to be self-binding, with successive wraps of the nonwoven material having opposed surfaces which interengage sufficiently to maintain the nonwoven material in a spirally-wrapped configuration, yet are sufficiently disengageable to permit unwinding of material from the roll. A nonwoven material having such surface characteristics can be folded or wadded into a desired shape and will hold such shape, without immediately springing open to a more flattened state. Thus, a single sheet of such a material can be conformed to a shape as desired by the end user.

In a preferred embodiment, the nonwoven abrasive material is wrapped spirally about itself to form a roll which is coreless. The material is unwound or removed from the roll from adjacent its innermost wrap, and a protective sheath is disposed about an outermost wrap of the roll. Preferably, the sheath is formed from a shrink-wrap process and, if desired, may bear product identifying indicia thereon.

In another preferred embodiment, the nonwoven abrasive article has an abrasive particle size and distribution which imparts a surface finish having values of Ra less than 10 microinches and a Bearing Ratio of between 15 and 60 percent, more preferably between 15 and 50 percent, and still more preferably between 15 and 40 percent. Such a nonwoven abrasive article is especially well-suited for scuffing automotive finishes prior to the application of subsequent coatings, for example.

BRIEF DESCRIPTION OF THE DRAWINGS

The present invention will be more fully described with reference to the accompanying drawings, wherein like reference numerals identify corresponding components.

Figure 1:
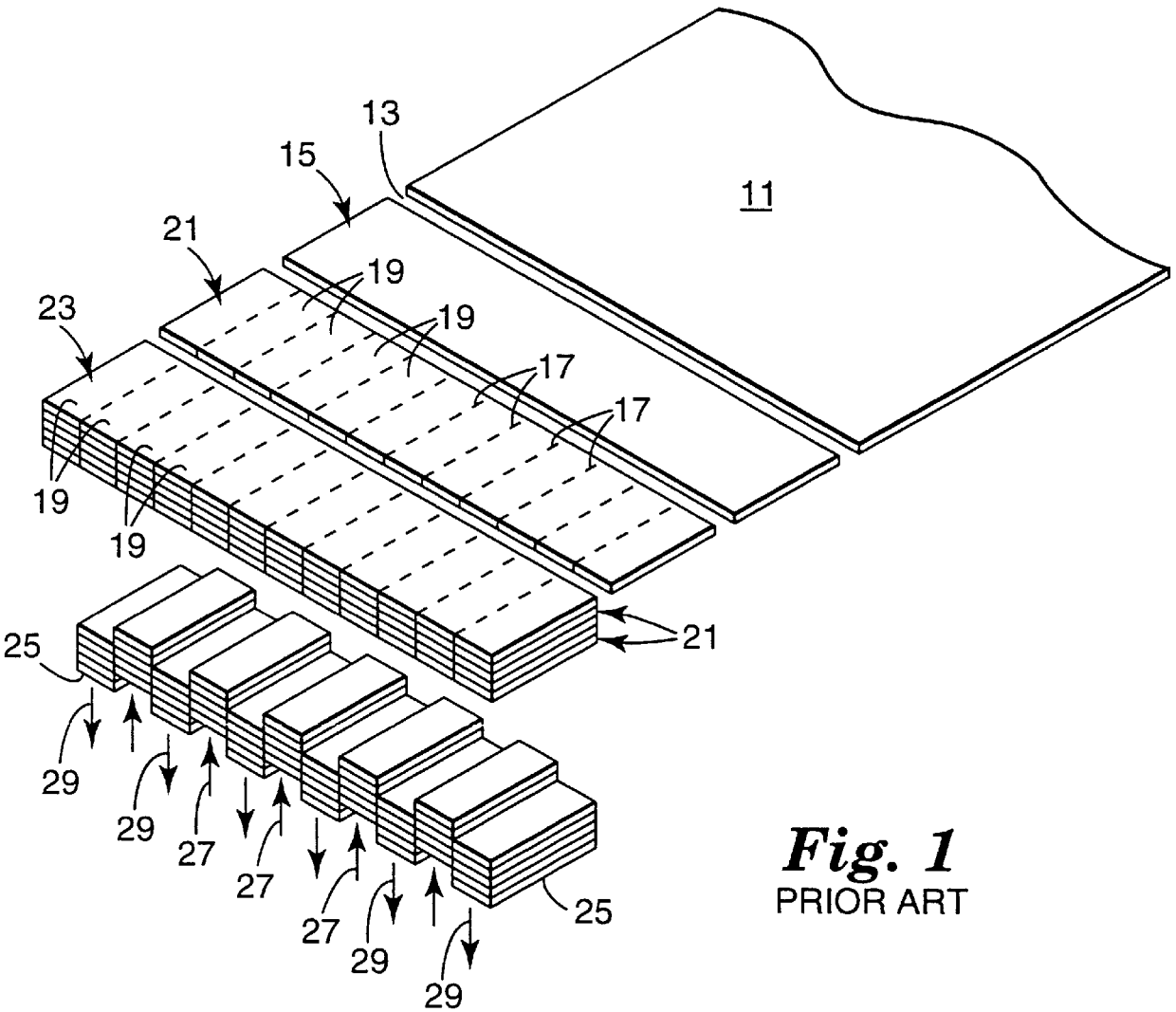
Fig. 1 PRIOR ART
FIG. 1 is a schematic illustration of a portion of a prior art process for manufacturing nonwoven abrasive material hand pads.

While the above-identified drawing features set forth preferred embodiments, other embodiments of the present invention are also contemplated, as noted in the discussion. The disclosure presents illustrative embodiments of the present invention by way of representation and not limitation. Numerous other modifications and embodiments can be devised by those skilled in the art, which fall within the scope and spirit of the principles of this invention. The drawing figures have not been drawn to scale as it has been necessary to enlarge or emphasize certain features for clarity of representation.

DETAILED DESCRIPTION OF THE PREFERRED EMBODIMENTS

Figure 2:
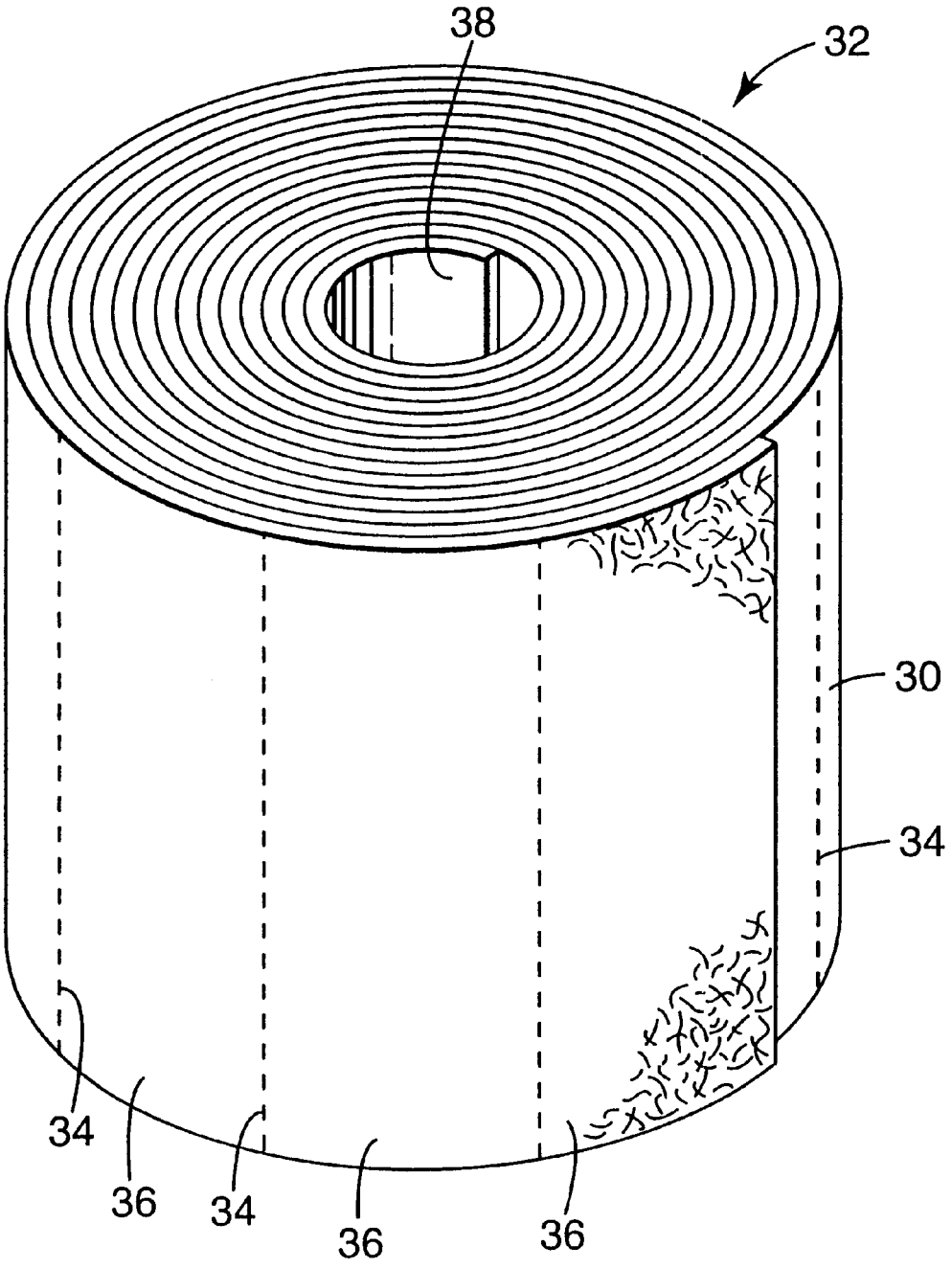
FIG. 2 is an isometric view of a roll of nonwoven material which is laterally perforated into sections, according to the teachings of the present invention.

FIG. 2 illustrates a roll of nonwoven abrasive surface treatment material formed and configured for use in connection with the present invention. The nonwoven abrasive material, described in more detail below, is initially formed as a longitudinal web 30, which is then spirally wrapped on a laterally disposed axis and configured as a roll 32. The web 30 is generally unitary in formation, and has incrementally spaced weakened areas across the web, as indicated by perforations 34. Individual sheets or sections 36 of nonwoven abrasive material can thus be separated from the roll 32 successively, along their respective perforations 34.

Figure 3:
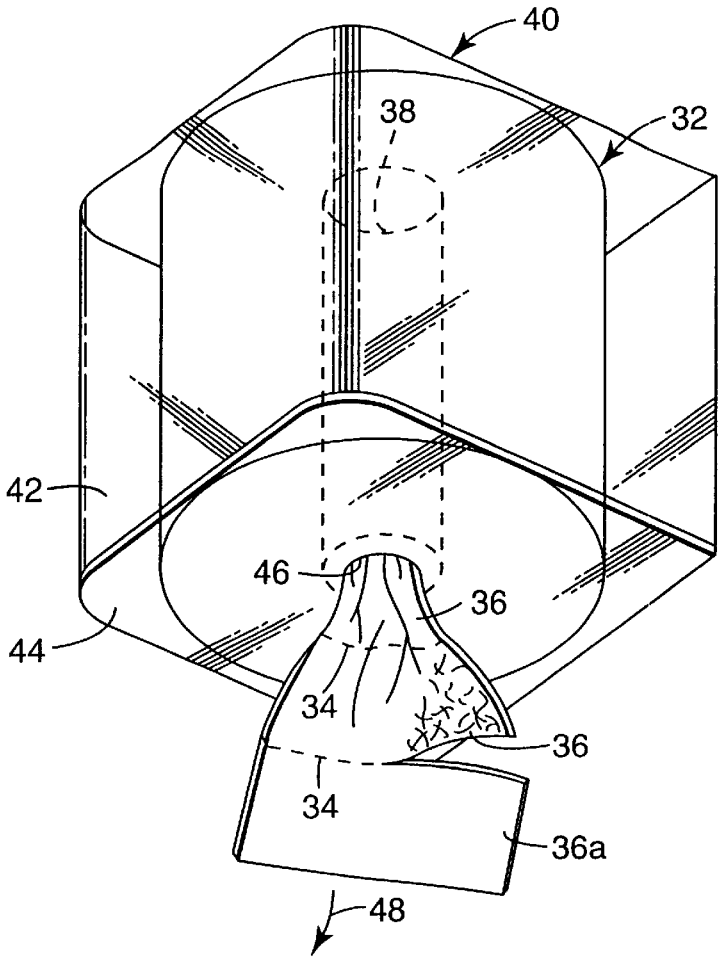
FIG. 3 is an isometric view of the roll of FIG. 2 aligned in a dispenser for holding the roll and readily dispensing successive sheets therefrom.

As seen in FIG. 2, the roll 32 is coreless (i.e., there is no core or central mandrel of other material centrally supporting the roll 32 in its final form as provided to the end user). A central cylindrical hole or opening 38 is left adjacent the innermost wrap of the roll 32 to permit access to its interior (i.e., to the nonwoven abrasive material of the innermost wrap). As seen in FIG. 3, the sheets 36 are preferably separated from the roll 32 in a center-pull or center feed manner, being removed successively from the end of the roll's innermost wrap. A dispenser 40 includes at least a side wall 42 surrounding the roll 32 and a bottom wall 44 supporting the roll 32. The roll 32 can be loaded within the dispenser 40 so that its central opening 38 is aligned with a central port 46 in the bottom wall 44, to permit access to the end of the innermost wrap of the roll 32. Single sheets 36 can then be accessed from the innermost wrap and readily separated from the remainder of the roll 32 along perforations 34, as desired by a user (such as by pulling on the exposed sheets in direction of arrow 48, as in FIG. 3, and particularly on end sheet 36*a*). The dispenser 40 is suitably adapted for mounting, such as on a wall, stand or other support, at a height and location for ready user accessibility. All of the sheets 36 on a roll 32 can be dispensed in this manner, until the roll in the dispenser is used up and needs to be replenished with a new roll of nonwoven abrasive surface treatment material.

Figure 4:
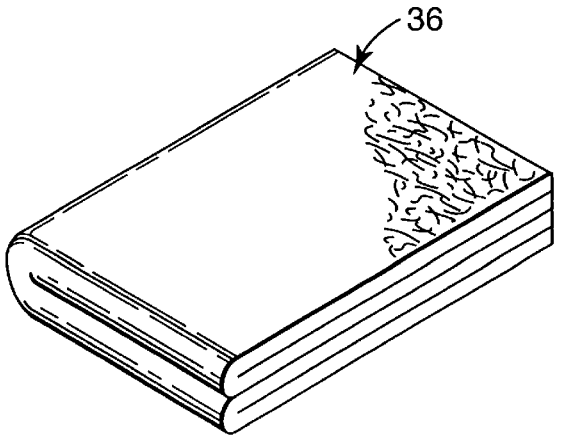
FIG. 4 is an isometric view of a sheet from the roll which has been folded for use.
Figure 5:
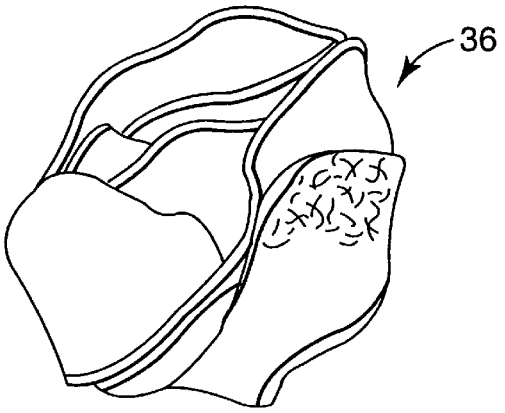
FIG. 5 is an isometric view of a sheet from the roll which has been crumpled for use.

The lofty nonwoven abrasive surface treatment material itself has certain desired characteristics. The nonwoven abrasive material is intended for use as a general purpose abrasive product in the areas of maintenance, degreasing, cleanup, repair, scuffing and detailing in automotive and general abrasive applications. It is desired that the nonwoven abrasive material provide the user a disposable abrasive product that is thin, useful and easy to dispense. Further, the surface characteristics of the nonwoven abrasive material are such that when spirally wrapped in a roll, successive layers of the material interengage or adhere together sufficiently to maintain the spirally wrapped roll configuration, but yet are readily disengageable to permit unwinding of material from the roll, either from adjacent an innermost wrap or an outermost wrap. Further, the individual sheets 36 formed from such nonwoven abrasive material have the ability to be folded or wadded into a desired shape by a user, and will retain that shape without immediately springing open. For example, FIG. 4 illustrates a sheet 36 folded to a desired shape, and FIG. 5 illustrates a sheet 36 wadded or crumpled upon itself. The interengaging surfaces of the sheet 36, as folded or wadded, tend to hold the formed shape rather than allowing the sheet to spring open to its more flattened, manufactured state. This feature thus results in a very conformable or "scrunchable" sheet 36 of nonwoven abrasive material, which more closely imitates the feel and look of a conformable pad of steel wool.

There appear to be several factors involved that affect the "scrunchability" of the sheet 36 formed of such nonwoven abrasive material. Thickness is the most obvious factor. Prior art hand pads of nonwoven abrasive material, when folded or wadded, tended to spring open because of their thickness. Weight is also a factor, since even a thin web will want to remain flat if it is a heavy web. Stiffness is also another trait that can be related to thickness and weight, but can also be a function of the materials of construction. Finally, the self-engaging surface characteristic of the web is an important factor tending to hold the web in a folded or wadded-up configuration, as illustrated in FIGS. 4 and 5. The interengaging surfaces catch or snag on one another to help hold the folds or creases in place and overcome the resilient forces of the web material that tend to want to make the sheet spring open to a more flattened state. This feature also permits the user to define other desired shapes. For example, a sheet can be wadded or rolled into a pencil-shaped configuration (with a tapered, cone-shaped end) which allows surface conditioning in otherwise inaccessible workpiece areas.

Figure 6:
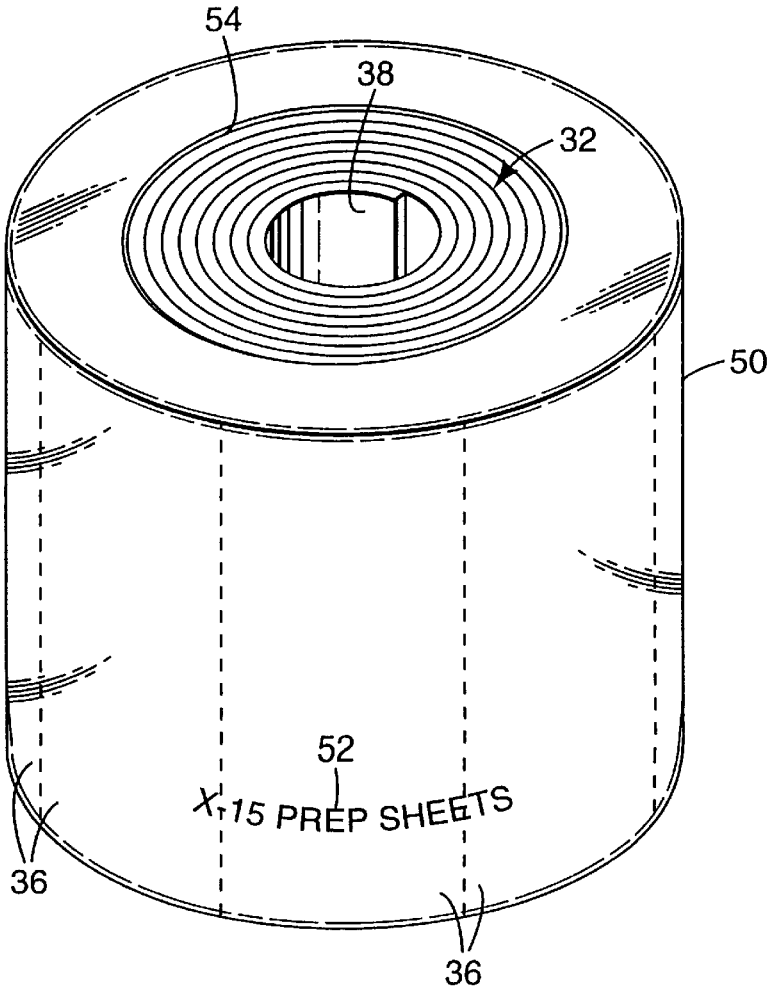
FIG. 6 is an isometric view of the roll of FIG. 2, encased in a protective sheath.

FIG. 6 shows a roll 32 as preferably provided to the end user. Although the outermost wrap of nonwoven abrasive material interengages with the next previous wrap and is thus secured thereon, an outer protective sheath 50 is provided around the outermost wrap of the roll 32. This sheath 50, which is preferably formed from a polyethylene, poly (vinyl chloride), or polyester shrink-wrap tubing as is well known in the art, with poly(vinyl chloride) being more preferred, protects the outermost wrap, prevents the roll 32 from inadvertent unwrapping, and also provides a means for providing commercial information and product identifying indicia 52. The shrink wrap sheath 50 completely covers the outermost wrap of the roll 32, but only partially covers its ends. The shrink wrap sheath 50 is open (as at opening 54) adjacent the central axis of the roll 32 (and its opening 38) to permit dispensing of sheets 36 from the innermost wrap of the roll 32 without removing the shrink wrap sheath 50.

Other advantages from this invention are illustrated in the following examples, which illustrate presently contemplated preferred embodiments and the best mode for practicing the invention, but are not intended to be limiting thereof.

EXAMPLES

Low density open, nonwoven abrasive material and methods for manufacture thereof are described in U.S. Pat. No. 2,958,593, the disclosure of which is incorporated herein by reference for such teachings. Alternative methods of preparing nonwoven abrasive materials are available, and include carding, wet-lay, air-lay and spunbond (as disclosed in U.S. Pat. No. 4,227,350, which is incorporated by reference). Specific to one preferred embodiment of the present invention, a light-weight open, nonwoven air-laid web is formed on a "Rando-Webber" machine, commercially available from the Rando Machine Corporation of Macedon, N.Y. The web is formed from 15 denier du Pont T852 (E. I. du Pont Nemours & Company, Seaford Plant, Seaford, Del.) a nylon crimp-set fiber with a staple length of one and one-half inches. The weight of the fiber mat is approximately 15 grains per four inch by six inch sample (63 grams per square meter), and the thickness is approximately 0.200–0.250 inches (5.08–6.35 mm). The fiber mat is conveyed to a horizontal, two-roll coater, where a prebond resin is applied at a weight of 15–19 grains per four by six inch sample (63–80 grams per square meter) wet. The prebond resin has the following composition:

| Component | Supplier | Percentage |
|---|---|---|
| Neste BB-077 Phenolic Resin | Neste Resins Canada, Mississauga, Ontario, Canada | 74.9% |
| Reactint Violet X80-LT | Milliken Chemicals, Blacksburg, South Carolina | 0.2% |
| Water | | 24.885% |
| "1520" Silicone Antifoam | Dow Corning Corporation, Midland, Michigan | 0.015% |

This resin has a percent solids of 52.5% and a viscosity of 100–200 centipoise.

After passing through the two-roll coater, the "wet" mat is conveyed to an oven which is maintained at a temperature of 190–195 degrees Celsius to initiate curing of the phenolic resin. Upon exiting the oven, the web is conveyed to a spray booth where a resin/abrasive slurry is sprayed on the top portion of the web. Within the booth, spray nozzles (which are mounted to reciprocate perpendicularly to the direction of web movement) apply the slurry at a weight of approximately 33 grains per four by six inch sample (138 grams per square meter). The spray slurry has the following composition:

| Composition | Supplier | Percentage |
|---|---|---|
| Neste BB-077 Phenolic | Neste Resins Canada, Mississauga, Ontario, Canada | 25.6% |
| Reactint Violet X80-LT | Milliken Chemicals, Blacksburg, South Carolina | 0.2% |
| Water | | 16.1% |
| Calcium Carbonate | | 4.2% |
| Aluminum Oxide (grade 280 and finer) | | 53.9% |

The slurry has a percent solids of 76.3 percent and a viscosity of 400–600 centipoise.

After spraying with this slurry, the web is conveyed to an oven which is maintained at a temperature of 190–195 degrees Celsius to further cure the phenolic resin. Upon exiting the oven, the web is inverted top to bottom and a spray coat is applied to the underside of the web. This spray coat composition, application technique, application amount, and thermal processing are identical to the first spray coat. Upon exiting the final oven, the cured web is wound on a winding mandrel to form a large jumbo roll of nonwoven abrasive web material.

This jumbo roll is converted into finished product by first slitting the web into eight inch wide master rolls which is then unwound, laterally cut and perforated. The preferred perforation blade is a four-tooth perforation (four perforations per inch), with each perforation cut being approximately 0.200 inch (5.08 mm) long, with the cuts spaced apart approximately 0.040 inch (1.016 mm). Each perforated unwound master roll is then cut to a desired length and each cut length is rolled up for final packaging. A shrink wrap or shrink wrap tube is applied around each final product roll and processed to shrink firmly around the roll, leaving holes of approximately four inches (10.16 cm) in diameter on the top and bottom of the roll, adjacent its central axis.

The final product is thus a shrink-wrapped, coreless roll of lofty, nonwoven abrasive surface treated material. In a preferred embodiment, the roll width is eight inches (20.32 cm) and its length (unwound) is twenty feet (6.096 m). The roll diameter (wound) is approximately nine inches (22.86 cm), and the center hole of the roll is approximately three inches (7.62 cm) in diameter. The web is laterally perforated every four inches (10.16 cm), resulting in a total of 60 eight by four inch (20.32 cm by 10.16 cm) sheets of nonwoven material per roll. The shrink wrap is formed from two to three mil, high clarity polyethylene shrink tubing, preprinted with the desired commercial end product and source identification information. The shrink wrap likewise has a center hole (preferably also approximately four inch (10.16 cm) on both the top and bottom of the roll of nonwoven abrasive material. This roll size and packaging thus results in a roll that is portable, protected and self-contained (or alternatively fits within most commercially available, wall-mount, center pull dispensers (e.g., existing dispensers for such products as paper towels and wipes), although the center hole in the bottom of the dispenser may need to be enlarged). The shrink wrap allows the roll of the nonwoven material to be readily carried as an individual, self-contained package of nonwoven abrasive material or dropped into such a dispenser without having to remove any of the roll's packaging material. Alternative packaging and dispensing means will also suffice to dispense sheets of the nonwoven abrasive material, such as a Z-fold dispenser, a stack of sheets or a cored roll of the material with dispensing from the outermost roll.

While a preferred embodiment for the formation of a specific roll of nonwoven abrasive material has been described above, other embodiments are possible within the scope of the present invention. For example, it is possible to have rolls with webs as short as two feet (0.6096 m) or as long as 160 feet (48.768 m), with lateral widths of from one to sixteen inches (2.54 to 40.64 cm). Roll diameter can be from two to twenty-four inches (5.08 cm to 60.96 cm), with a central opening diameter extending from zero up to about 16 inches (40.64 cm). The perforations can be spaced longitudinally between a range of one inch (2.54 cm) (to form short strips) or up to 24 inches (60.96 cm) (to prepare long, foldable sheets of nonwoven abrasive material).

A preferred perforation arrangement for this specific example is specified above. This perforation arrangement was selected for the preferred embodiment based on an analysis of the linear force required to separate adjacent perforated sheets, using different perforation schemes. Samples of the nonwoven abrasive material made as described above were perforated using different perforation blades, and then tensile tested to break the perforations. Six different blade configurations were examined in this regard:

⅛"×1⁄16" Perforation—⅛" cut, 1⁄16" no cut

1⁄16"×1⁄16" Perforation—1⁄16" cut, 1⁄16" no cut

4 Tooth Perforation—Four perforations per inch (approximately 0.200" wide) with a no cut (approximately 0.040") separating each perforation 6 Tooth Perforation—Six perforations per inch (approximately 0.125" wide) with a no cut (approximately 0.040") separating each perforation 8 Tooth Perforation—Eight perforations per inch (approximately 0.080" wide) with a no cut (approximately 0.040") separating each perforation 10 Tooth Perforation—Ten perforations per inch (approximately 0.060" wide) with a no cut (approximately 0.040") separating each perforation One inch wide strips of the above examples of nonwoven abrasive material (perforated laterally relative to web advance during web processing) were clamped into a constant rate of extension tensile testing machine, and evaluated using ASTM test method 16-82, the standard method for breaking load and elongation of textile fabrics using the cut strip option. Each strip was aligned with its perforation at its midpoint, and the force to separate the strip along its perforation was measured in pounds force, and the characteristic force recorded was the peak load. As shown in the chart below, a number of samples for each perforation blade were tested:

| Perforation Blade | Peak Load (lb.) | Number of Samples | Standard Deviation |
|---|---|---|---|
| 1/8" × 1/16" | 5.1 | 6 | 0.7 |
| 1/16" × 1/16" | 7.2 | 7 | 1.1 |
| 4 Tooth | 1.8 | 8 | 0.4 |
| 6 Tooth | 2.9 | 8 | 0.2 |
| 8 Tooth | 3.8 | 8 | 0.9 |
| 10 Tooth | 4.3 | 8 | 0.6 |

As noted above, in the preferred embodiment, the 4-tooth perforation blade was selected, which provided sufficient strength to disengage the innermost wrap from the roll, yet allowed easy separation of adjacent sheets once two or more sheets were free from the center hole of the roll.

The above example provides a nonwoven abrasive material formed in a two-roll coater process, where a first coating serves to bond the web fibers together and a second coating applies abrasive material to the web. Other coating methods include roll coating and spray coating of abrasive-bearing coatings, including coating directly onto the bare fibers of the web, with no prebond coating. Additional examples of nonwoven abrasive material were formed using the roll coating compositions and coating processes as follows:

| Component | Roll Coat #1 | Roll Coat #2 | Roll Coat #3 | Abrasive Roll Coat #1 | Abrasive Spray Coat #1 | Abrasive Spray Coat #2 |
|---|---|---|---|---|---|---|
| Water | 42.9% | 24.96% | 26.2% | 22.62% | 17.46% | 29.1% |
| Phenolic Resin | 56.7% | 74.64% | 74.8% | 22.62% | 23.57% | 29.4% |
| Surfactant FC-170 C.[1] | 0.2% | 0.1% | — | 0.11% | — | — |
| "Reactint" Violet X80LT[2] | 0.2% | 0.3% | — | 0.22% | 0.2% | — |
| calcium carbonate | — | — | — | 3.88% | 4.24% | — |
| "Carbopol" EZ-1[3] | — | — | — | 0.22% | — | — |
| aluminum oxide (grade 280 and finer) | — | — | — | 50.33% | 54.53% | — |
| "Q2" antifoam[4] | — | — | 0.015% | — | — | — |
| silicon carbide (grade 1000 and finer) | — | — | — | — | — | 41.5% |

[1]a non-ionic fluorinated surfactant available from Minnesota Mining and Manufacturing Company, St. Paul, MN
[2]dye, available from Milliken Chemicals, Blacksburg, SC
[3]available from B. F. Goodrich Company, Cleveland, OH
[4]available from Dow Corning Co., Midland, MI The phenolic resin is a condensate of a 1.96 to 1.0 formaldehyde to phenol ratio, with about 2% potassium hydroxide. It is a 70% solids solution, with 25–28% water and 3–5% propylene glycol ether.

Using these compositions, a number of samples of nonwoven abrasive material were formed with the parameters set forth in Table 1 below:

TABLE 1

| Sample | Web Weight (grains/24 in$^2$) | Fiber Type & Size (denier) | Prebond Method | Roll Coat # | Roll Coat Add-on (grains/24 in$^2$ dry weight) | Abrasive Roll Coat # | Abrasive Roll Coat Add-on (grains/24 in$^2$ dry weight) | Abrasive Spray Coat # | Abrasive Spray Coat Add-on (grains/24 in$^2$ total dry weight) |
|---|---|---|---|---|---|---|---|---|---|
| A | 10 | 6 d. nylon | phenolic | 1 | 12 | 1 | 56 | — | — |
| B | 10 | 6 d. nylon | phenolic | 1 | 12 | — | — | 1 | 50 |
| C | 10 | 85% 6 d. nylon 15% 4 d. "Celbond" | thermally-bondable fiber | — | — | 1 | 36 | — | — |
| D | 10 | 85% 6 d. nylon 15% 4 d. "Celbond" | thermally-bondable fiber | — | — | — | — | 1 | 51 |
| E | 15 | 15 d. nylon | phenolic | 2 | 11 | 1 | 53 | — | — |
| F | 15 | 15 d. nylon | phenolic | 2 | 9 | — | — | 1 | 50 |
| G | 15 | 15 d. nylon | none | — | — | — | — | 1 | 76 |
| H | 15 | 85% 15 d. nylon 15% 15 d. "Celbond" | thermally-bondable fiber | — | — | — | — | 1 | 44 |
| I | 15 | 15 d. nylon | none | — | — | — | — | 1 | 64 |
| J | 15 | 15 d. nylon | none | — | — | 1 | 49 | — | — |
| K | 15 | 15 d. nylon | none | — | — | 1 | 28 | — | — |
| L | 15 | 15 d. nylon | phenolic | 3 | 8 | — | — | 2 | 25 |

The references in Table 1 to fiber type and size are more specifically detailed as:

6 d. nylon is six denier du Pont P-113, available from E. I. du Pont de Nemours & Company, Seaford Plant, Seaford, Del.;

15 d. nylon is 15 denier du Pont T-852, available from E. I. du Pont de Nemours & Company, Seaford Plant, Seaford, Del.;

4 d. "Celbond" is four denier thermally bondable fiber available from Hoechst-Celanese, of Charlotte, N.C.; and 15 d. "Celbond" is 15 denier thermally bondable fiber available from Hoechst-Celanese, of Charlotte, N.C.

In Table 1, "Prebond Method" refers to three options: phenolic, thermally bondable fiber or none. The "phenolic" prebond method includes a resin roll coat step to bond the loose web fibers together, with an oven cure at 190–195 degrees Celsius. The "thermally bondable fiber" prebond method includes no resin coating, but rather simply an oven heating of the web to bond the loose fibers together, again at 190–195 degrees Celsius. The "none" prebond method includes no specific step to bond the loose web fibers together, but rather doing so in the course of applying the abrasive coating, via roll coating or spray coating.

In addition to specifying which sample (e.g., samples A–L) were formed from which material, and subjected to which prebond, Table 1 also specifies the nature of the coating and their respective dry weights added to each sample by each of the coatings.

Two testing schemes were devised in order to measure the stiffness and self-engaging nature of the nonwoven abrasive material samples A to L and to compare those samples to prior art nonwoven abrasive materials. The stiffness of the samples and prior art materials was determined by a three-point flex test based on the procedures described in ASTM Test Method D 790, "Standard Test Method for Flexural Properties of Unreinforced and Reinforced Plastics and Electrical Insulating materials." Five 1 inch by 6 inch (2.54 cm×15.24 cm) specimens were cut from each example web. The average thickness for each example was determined by measuring a stack of five specimens. Test specimens were mounted in a three-point fixture having contact points comprising ⅛ inch (0.32 cm) diameter dowels spanning 1 inch (2.54 cm), the fixture being mounted in a constant rate of extension tensile testing machine. The test was initiated and the crosshead moved at 1 inch (2.54 cm) per minute to an initial limit of 2% strain. The force was then tared and the test continued to a final limit of 5% strain. The bending force in grams at 5% strain was recorded.

The self-engaging phenomenon was measured by overlapping two one by five inch (2.54 cm by 12.70 cm) strips of each of the nonwoven abrasive material samples and prior art end to end with a two inch (5.08 cm) overlap. The overlapped strips were then placed on a vibratory feed motor with a one pound weight on top of the overlap. The vibratory motor was a Syntron Magnetic Feeder, Model F-TOC, controlled by a Syntron Electric Controller, Model CSCR-1B, both available from FMC Corporation's Material Handling Equipment Division, Homer City, Pa. The motor was run for 15 seconds at a controller setting of six. The weight was then removed and a paper support was wrapped around the overlapped area to prevent movement during transport and securing in a tensile test fixture. The ends of the strip were clamped into a constant rate of extension tensile testing machine, and evaluated using ASTM Test Method 16-82, the standard method for breaking load and elongation of textile fabrics using the cut strip option. The force to pull the two strips apart was measured in grams force, and the characteristic force recorded was the peak load.

Table 2 below presents the average measured values for the samples, both for samples A to L, and for five prior art nonwoven abrasive materials. To incorporate thickness and weight into the analysis, the required bending force was divided by the density of the nonwoven abrasive materials being tested. This combines the properties of thickness, weight and stiffness into one variable.

The five prior art nonwoven abrasive materials considered in these tests include three products from Minnesota Mining and Manufacturing sold under the registered trademark "SCOTCH-BRITE." These three Minnesota Mining products are also further identified by product Nos. 96, 7447, and 7448. In Table 2, these products are identified as 3M-96, 3M-7447 and 3M-7448, respectively. Another prior art nonwoven abrasive material considered is manufactured by Mirka of Finland, and is identified commercially as Mirka "MIRLON" surface finishing pad 18-111-447, grit very fine. In Table 2, this product is identified as Mirka-447. The other prior art nonwoven abrasive material considered is manufactured by Norton of Worcester, Mass. This product is identified commercially as Norton "BEAR-TEX" No. 747 general purpose hand pad, grit very fine. In Table 2, this product is identified as Norton-747.

TABLE 2

SURFACE ENGAGEMENT AND BENDING FORCE

| Sample/ID | Thickness (inches) | Density (grams per cubic inch) | Surface Engagement Strength (grams) | Bending Force (grams) | Bending Force/ Density |
|---|---|---|---|---|---|
| 3M-96 | 0.366 | 0.916 | 23.0 | 28.10 | 30.664 |
| 3M-7448 | 0.350 | 0.762 | 25.1 | 23.50 | 30.851 |
| Mirka-447 | 0.390 | 1.165 | 59.5 | 58.4 | 50.145 |
| 3M-7447 | 0.420 | 0.911 | 41.8 | 39.00 | 42.812 |
| Norton-747 | 0.400 | 1.070 | 38.7 | 32.40 | 30.280 |
| A | 0.135 | 1.686 | 13.0 | 10.50 | 6.228 |
| B | 0.130 | 1.615 | 13.6 | 4.85 | 3.002 |
| C | 0.200 | 0.693 | 15.4 | 0.80 | 1.154 |
| D | 0.128 | 1.311 | 21.6 | 1.10 | 0.839 |
| E | 0.310 | 0.680 | 40.1 | 6.20 | 9.118 |
| F | 0.320 | 0.613 | 54.7 | 5.35 | 8.726 |
| G | 0.260 | 0.942 | 61.6 | 5.00 | 5.306 |
| H | 0.280 | 0.540 | 50.7 | 2.40 | 4.444 |
| I | 0.315 | 0.527 | 64.1 | 2.20 | 4.175 |
| J | 0.260 | 0.592 | 35.7 | 1.80 | 3.039 |
| K | 0.216 | 0.464 | 46.8 | 0.56 | 1.207 |
| L | 0.300 | 0.593 | 35.5 | 13.7 | 23.103 |

A Scratch Test provides a means of comparing the surface finish imparted to a workpiece by the action of an abrasive article. The test workpiece is a 15 inch×15 inch×0.25 inch thick acrylic sheet. A number of 2 inch by 4.25 inch specimens are cut from the abrasive materials to be tested and placed in contact with the acrylic sheet. The acrylic sheet is labeled to identify each test specimen. A 2 inch by 4.25 inch weighted sanding block weighing 8.32 lbs. is then placed across the test specimens such that the test specimens are compressed against the workpiece. The sanding block is then linearly reciprocated across the 15-inch dimension of the acrylic sheet. Following 50 full cycles of abrading in this manner, the sanding block and test specimens are removed from the acrylic sheet, the sheet is cleaned with window cleaning solution and a paper towel, and surface finish is measured in a direction perpendicular to the direction of the abrasion at 4 equally-spaced places along the abraded length of the abraded track. The surface finish is measured using a "Perthen S6P" No. 680 0602 profilometer, available commercially from Feinpruf GmbH, Gottingen, Germany. This device is capable of measuring and calculating many surface profile parameters, but for the purposes of this test, the parameters Average Roughness (Ra) and Bearing Ratio are recorded. The Average Roughness is the arithmetic average of the depth of all sequential peak-to-valley scratches imparted to the surface along a test path and is measured in microinches. Values of Ra generally vary with the grade of abrasive particles present in the abrasive article. The Bearing Ratio is a measurement by which one can examine imaginary "slices" or planes parallel to the abraded surface as they move deeper into the abraded surface and is expressed as a fraction (or percentage) of the abraded surface that would be a "bearing" surface if the imaginary slice were being supported at that distance from the surface of a test path. Such measurements provide a means for determining the uniformity of abrasion imparted by the test specimen and the shape of the resulting scratches. In practice, a reference point is chosen and the Bearing Ratio is calculated as the plane is incrementally moved deeper into the abraded substrate until it has progressed through the abraded surface, thereby generating a Bearing Ratio value of 1 (or 100%). For comparative purposes, Bearing Ratio values at a test "slice" at a constant distance from the reference point are reported. For abrasive articles useful in the preparation of automotive finishes for subsequent coatings, an abraded surface Bearing Ratio of approximately 15–60% is preferred, with a value of approximately 15–50% being more preferred, and a value of approximately 15–40% being still more preferred.

In addition to the Bending Force and Engagement Force tests reported with respect to examples A–L above, the surface finish imparted by the abrasive sheet of Example L was compared to that of commercially available abrasive articles by performing the Scratch Test using a Bearing Ratio reference plane of 5%=0 $\mu$m; that is, a depth of 5% of the average scratch depth is re-defined as a reference plane of 0.0 micrometers depth. The Bearing Ratio is reported at the plane that is at a depth of 0.3 micrometers relative to the 0.0 reference plane. The values reported in Table 3 are the average of specimen top and bottom sides. Ra is reported in microinches and Bearing Ratio is reported in percent. As used herein, including the claims, the terms "Ra" and "Bearing Ratio" are used to indicate the results attained when the just-described Scratch Test is performed.

Also presented in Table 3 is the add-on weight of the abrasive grains for the articles, and the combined add-on weight (dry) for the abrasive grains and binders (including prebond and bond resins). The data in Table 3 show that the sheet of Example L produces a surface finish that is fine (Ra<10 microinches) and very uniform without jagged scratches (Bearing Ratio<50%). Surprisingly, these results were attained with abrasive articles having significantly lower abrasive grain add-on weight than comparative products achieving similar surface finish and bearing ratio.

TABLE 3

| Example | Total Weight | Abrasive Grain Weight | Total Resin and Abrasive Grain Weight | Thickness (mils) | Density (g/in$^3$) | Ra | Ra standard deviation | Bearing Ratio @ 0.3 $\mu$ |
|---|---|---|---|---|---|---|---|---|
| Type S[5] | 117 | 40.8 | 77.6 | 345 | 0.92 | 8.49 | 0.32 | 40.8 |
| Type S[5] | 113 | 40.8 | 77.6 | 412 | 0.74 | 3.28 | 0.32 | 91.8 |
| Type S, (FR)[6] | 94 | 27.9 | 56.8 | 371 | 0.69 | 5.28 | 0.81 | 73.9 |
| Standard[7] | 125 | 36.4 | 85.8 | 400 | 0.85 | 6.10 | 0.55 | 66.5 |
| Norton[8] | 140 | 54.9 | 80.9 | 492 | 0.77 | 3.42 | 0.66 | 88.6 |
| Mirka UK[9] | 88 | 37.0 | 61.4 | 360 | 0.66 | 9.77 | 0.40 | 33.6 |
| Sia[10] | 83 | 39.1 | 60.8 | 401 | 0.56 | 11.93 | 0.82 | 24 |
| Mirka[11] | 97 | 36.6 | 50.2 | 400 | 0.66 | 9.60 | 0.64 | 32.6 |
| Steel Wool #2 | — | | | — | | 14.9 | — | — |
| Steel Wool #0 | — | | | — | | 12.3 | — | — |
| Steel Wool #00 | — | | | — | | 7.1 | — | — |
| Steel Wool #0000 | — | | | — | | 7.1 | — | 53.5 |
| Ex. L | 49 | 18.5 | 33.5 | 295 | 0.45 | 9.25 | 0.44 | 35.6 |
| Ex. L | 65 | 29.1 | 49.5 | 312 | 0.57 | 9.16 | 0.66 | 40.8 |
| Ex. L | 52 | 20.5 | 36.5 | 266 | 0.53 | 9.70 | 0.62 | 34.8 |
| Ex. L | 54 | 21.8 | 38.5 | 248 | 0.59 | 8.88 | 0.66 | 35.5 |

All weights reported in grains/24 in$^2$
[5]"Type S Ultra Fine", Minnesota Mining and Manufacturing Company, St. Paul, MN
[6]"3M 7448", 3M France, Paris, France
[7]"Brite Rite EZ Ultra Fine", Standard Abrasives, Chatsworth, CA
[8]"Norton Bear Tex 748", Norton Abrasive Company, Worcester, MA
[9]"Mirka Ultrafine Hand Pad 18-111-448", Mirka Abrasives, London, England
[10]"Sia Strips Ultra Fine No. 9173", Sia American, Lenoir, NC
[11]"Mirka Merlon Surface Finishing Pad UF", No. 18-111-448, Mirka Abrasives, Twinsburg, OH As mentioned above, the self-engaging nature or "scrunchability" of the nonwoven abrasive material adds a unique feature to the end product. A roll of this material is wound and the end of the outermost wrap simply pressed against the previous wrap to maintain a self-adhering wrap of nonwoven abrasive material about the roll. No tape, adhesive or mechanical fasteners are required to secure the successive wraps of nonwoven abrasive material together. Thus, the product is essentially self-packaging. The addition of the shrink wrap sheath is simply to increase durability, keep the product clean and provide a platform for product identification.

In a preferred embodiment, the nonwoven abrasive material is perforated to create a weakened area across the material for separating adjacent sheets of the material from the roll. Any type of mechanical perforation method is applicable, including water jet perforation and mechanical blade perforation. Imparting a high degree stretch at specific points in the web, specific alignment of the fibers and various web formation methods can also create weakened areas across the web that could be used to enhance the separation or tear of adjacent sheets. In web formation, an air knife could be used to alter the web integrity in a line across the web for tearing purposes.

In the preferred embodiment of the present invention, the desired objective during the dispensing operation is that all sheets remain contiguously attached until the innermost wrap (comprising one free end and at least two sheets with included perforations) is completely freed from the roll's center hole. Once the innermost wrap is free from the center hole of the roll (and end opening of optional protective sheath), it is then that an application of incrementally greater force may be applied to separate the end sheet from its adjacent sheet along the perforation therebetween. It is important that the force required to separate adjacent sheets be appropriate for the nonwoven abrasive material involved. The perforation strength (i.e., the force required to separate adjacent sheets such as exerted along arrow 48 in FIG. 3) requirements vary depending on the various embodiments of the article of the present invention. Generally, the perforation strength must be greater than the interengagement strength, but less than the tensile or shear strength of the abrasive material itself. For example, abrasive sheets with high interengaging capacity will require a greater perforation strength in order to avoid premature separation of the sheets when dispensed from the center hole of the roll. Likewise, a wider roll will require a greater perforation strength since more interengagements must be overcome. Further, the roll center hole internal diameter (i.d.) affects the perforation strength requirements since, as the i.d. becomes larger, the sheets are more easily dispensed, and thus the perforation strength may be decreased. Obviously, during the consumption of the roll of abrasive material, as more sheets are dispensed from the roll, the perforation strength requirements become less as the i.d. of the center hole becomes larger. Similarly, if the end opening of the protective sheath is small in diameter (i.e., less than about 3 inches (7.62 cm)), the perforation strength requirement is higher than if the opening is relatively large (i.e., about 5 inches (12.7 cm) or more).

In examples A–K detailed above, the abrasives specified are relatively aggressive abrasives. An appropriate abrasive characteristic for the nonwoven material would be selected by a person of ordinary skill in the art, depending upon the workpiece and desired surface treatment. Thus, aggressive is a relative term dependent on these factors. It is understood that any abrasive, including a soft abrasive, a hard abrasive, or a mixture thereof, will suffice in connection with a nonwoven material to create a nonwoven abrasive web having the inventive characteristics. Soft abrasives, having a Mohs hardness in the range of about 1 to 7, provide the nonwoven web material with a mildly abrasive surface. Examples of soft abrasives include such inorganic materials as garnet, flint, silica, pumice, and calcium carbonate; and such organic polymeric material as polyester, poly(vinyl chloride), poly(methacrylic acid), poly(methylmethacrylate, polycarbonate, polystyrene, and particles of thermosetting polymers such as melamine-formaldehyde condensates. Hard abrasives, those having a Mohs hardness greater than about 8, provide the nonwoven web material with an aggressive abrasive surface. Examples of hard abrasives include such materials as silicone carbine, aluminum oxide, topaz, fused alumina-zirconia, boron nitride, tungsten carbide, and silicon nitride. The particle size of the abrasive material can be any desired size, but typical sizes are from about 80 grade (average diameter approx. 200 micrometers) to about 1000 grade (average diameter approx. 3 micrometers) or finer.

It is also within the scope of the present invention to use even finer abrasive particles, as detailed with respect to example L. Abrasive particles of 1000 grade and finer are useful for imparting fine surface finish as measured by both Ra and Bearing Ratio. Such an article can be constructed, for example, with an abrasive particle and binder mixture in which the abrasive particles comprise approximately 40–80%, preferably approximately 66%, by dry weight of the binder and particle mixture, with an abrasive particle and binder mixture dry add-on weight of approximately 15–50 grains per 24 $in^2$, and preferably approximately 25 grains per 24 $in^2$. For the 15–50 grains per 24 $in^2$ range of mixture add-on weight, the 40–80% preferred range of abrasive grains has an add-on weight of from 6–40 grains per 24 $in^2$, and the 66% preferred amount of abrasive grains has an add-on weight of 10–33 grains per 24 $in^2$. For the embodiment of approximately 25 grains per 24 $in^2$ mixture add-on weight, the 40–80% preferred range of abrasive particles has an add-on weight of approximately 10–20 grains per 24 $in^2$, and the 66% preferred amount has an abrasive grain add-on weight of approximately 16.7 grains per 24 $in^2$. Thus, abrasive grains were preferably present in the amount of from 6–40 grains per 24 $in^2$, more preferably 10–33 grains per 24 $in^2$, still more preferably 10–20 grains per 24 $in^2$, and most preferably approximately 16.7 grains per 24 $in^2$.

It is seen from the data presented in Table 3 that such nonwoven abrasive material can provide a surface finish comparable to that of #00 and #0000 steel wool. Such an abrasive particle size can advantageously be used with the "scrunchable" nonwoven material described above, and can also be advantageously used in other, "non-scrunchable" nonwoven material. Particle size distribution was measured with a Coulter Multisizer II, available from Coulter Electronics, Limited, Bedford, England. Particle size distributions (size reported in micrometers) of two batches of abrasive material suitable for use with the 1000 grade and finer embodiment are reported in Table 4 as volume percent. It is understood that this is reported by way of example only, and that the 1000 grade and finer embodiment of the present invention is not limited to the particular abrasive particle size distribution of Example L.

TABLE 4

| Batch | 3% | 5% | 50% | 90% | 95% |
|---|---|---|---|---|---|
| 1 | >11.45 | >10.32 | >4.72 | >2.26 | >1.88 |
| 2 | >14.72 | >13.8 | >6.8 | >2.6 | >2.0 |

The nonwoven material itself (a nonwoven three-dimensional lofty web of crimped or undulated synthetic fibers which are adhesively bonded at points of mutual contact with a binder material), without a specific coating of "abrasive" particles, may have the desired abrasive characteristics. Again, this is dependent upon the nature of the workpiece and the intended surface treatment for that workpiece.

Although the present invention has been described with reference to preferred embodiments, workers skilled in the art will recognize that changes may be made in form and detail without departing from the spirit and scope of the invention.

What is claimed is:

1. An abrasive surface treatment material, comprising:

a web of lofty nonwoven material including 1000 grade and finer abrasive particles bonded thereto by a binder, wherein the abrasive particle add-on weight is 10–33 grains per 24 $in^2$, wherein the density of the surface treatment material is less than 0.6 grams/$in^3$, and wherein when tested according to the Scratch Test defined herein, provides an Ra of less than 10 microinches and a Bearing Ratio of from 15–50%.

2. The abrasive material of claim 1, wherein the abrasive particle add-on weight is 10–20 grains per 24 $in^2$.

3. The abrasive material of claim 1, wherein when tested according to the Scratch Test defined herein, provides an Ra of less than 10 microinches and a Bearing Ratio of from 15–40%.

4. A longitudinally extending web of lofty nonwoven abrasive surface treatment material comprising the abrasive surface treatment material of claim 1, and further comprising:

a plurality of longitudinally spaced and laterally disposed weakened areas across the web to permit a user to readily and successively separate the web into a plurality of sheets of abrasive surface treatment material.

5. The web of claim 4 wherein each weakened area is defined by perforations formed through the web.

6. The web of claim 4, wherein the web is wrapped spirally about itself to form a roll of abrasive surface treatment material.

7. A roll of lofty nonwoven abrasive surface treatment material of claim 1, comprising:

the roll being self-binding with successive wraps of the nonwoven material having opposed surfaces which interengage sufficiently to maintain the nonwoven material in a spirally wrapped configuration, yet are disengageable to permit unwinding of material from the roll.

8. The roll of claim 7 wherein the roll is coreless.

9. The roll of claim 8, and further comprising:

a protective sheath disposed about an outermost wrap of the roll.

10. The roll of claim 7 wherein the roll of nonwoven material has a plurality of longitudinally spaced and laterally disposed weakened areas therealong to permit a user to readily and successively separate the nonwoven material into a plurality of separate sheets.

11. A roll of lofty nonwoven abrasive surface treatment material of claim 1 that is spirally wrapped about a central axis into a roll, comprising:

successive wraps of the nonwoven material having interengaging surfaces sufficient to maintain the material in a spirally wrapped configuration, yet being readily separable; and a plurality of longitudinally spaced and laterally disposed weakened areas across the nonwoven material, thereby defining a plurality of readily separable abrasive surface treatment material sections along the web.

12. The roll of claim 11 wherein each the weakened area is defined by perforations formed through the web.

13. The roll of claim 11 wherein the roll is coreless.

14. The roll of claim 11, and further comprising:

a protective sheath disposed about an outermost wrap of the roll.

15. An abrasive surface treatment material, comprising:

a web of lofty nonwoven material including 1000 grade and finer abrasive particles bonded thereto by a binder, wherein the abrasive particle add-on weight is 10–20 grains per 24 $in^2$, wherein the density of the surface treatment material is less than 0.6 grams/$in^3$, and wherein when tested according to the Scratch Test defined herein, provides an Ra of less than 10 microinches and a Bearing Ratio of from 15–50%.

16. A longitudinally extending web of lofty nonwoven abrasive surface treatment material comprising the abrasive surface treatment material of claim 15, and further comprising:

a plurality of longitudinally spaced and laterally disposed weakened areas across the web to permit a user to readily and successively separate the web into a plurality of sheets of abrasive surface treatment material.

17. The web of claim 16, wherein the web is wrapped spirally about itself to form a roll of abrasive surface treatment material.

18. A roll of lofty nonwoven abrasive surface treatment material spirally wrapped about a central axis into a roll, comprising:

a web of lofty nonwoven material including 1000 grade and finer abrasive particles bonded thereto by a binder, wherein the abrasive particle add-on weight is 10–20 grains per 24 $in^2$, wherein the density of the surface treatment material is less than 0.6 grams/$in^3$, wherein when tested according to the Scratch Test defined herein, provides an Ra of less than 10 microinches and a Bearing Ratio of from 15–50%, wherein successive wraps of the nonwoven material have interengaging surfaces sufficient to maintain the material in a spirally wrapped configuration, yet being readily separable, and including a plurality of longitudinally spaced and laterally disposed weakened areas across the nonwoven material, thereby defining a plurality of readily separable abrasive surface treatment material sections along the web.

* * * * *

UNITED STATES PATENT AND TRADEMARK OFFICE

CERTIFICATE OF CORRECTION

PATENT NO. : 6,207,246 B1
DATED : March 27, 2001
INVENTOR(S) : Moren, Louis S.

It is certified that error appears in the above-identified patent and that said Letters Patent is hereby corrected as shown below:

Column 9,
Line 64, “materials” should read -- Materials --.

Signed and Sealed this

Fourteenth Day of January, 2003

JAMES E. ROGAN
*Director of the United States Patent and Trademark Office*